United States Patent [19]

Specht et al.

[11] 4,110,191

[45] Aug. 29, 1978

[54] SEPARATOR-ELECTRODE UNIT FOR ELECTROLYTIC CELLS

[75] Inventors: Steven J. Specht, Cleveland; John O. Adams, Englewood, both of Tenn.

[73] Assignee: Olin Corporation, New Haven, Conn.

[21] Appl. No.: 824,999

[22] Filed: Aug. 16, 1977

[51] Int. Cl.[2] ..... C25B 9/00; C25B 13/02

[52] U.S. Cl. ..... 204/266; 204/263; 204/295; 204/296

[58] Field of Search ..... 204/263, 266, 128, 98, 204/296, 295, 129, 257–258

[56] References Cited

U.S. PATENT DOCUMENTS

| | | | |
|---|---|---|---|
| 1,797,377 | 3/1931 | Smith | 204/266 |
| 3,117,066 | 1/1964 | Juda | 204/128 |
| 3,930,151 | 12/1975 | Shibata et al. | 204/266 |
| 3,984,303 | 10/1976 | Peters et al. | 204/260 |

*Primary Examiner*—R. L. Andrews

*Attorney, Agent, or Firm*—Bruce E. Burdick; Donald F. Clements; Thomas P. O'Day

[57] ABSTRACT

An electrode-separator combination unit for use in an electrolytic cell having planar interleaved electrodes and a method of assembling such a unit. Electrodes are individually enclosed in a closed envelope of separator material to form individual electrolyte chambers. The separator can be perforated and electrical conductors, fluid supply conduits and fluid outlet conduits can be sealingly passed through the perforations to allow supply of raw materials to the enclosed electrodes and to allow removal of products therefrom.

67 Claims, 14 Drawing Figures

SEPARATOR-ELECTRODE UNIT FOR ELECTROLYTIC CELLS

In the production of halogen gases and alkali metal hydroxides, such as for example caustic soda, in "diaphragm-type" electrolytic cells, materials having selective ion-exchange properties are now becoming available for use as anolyte-catholyte separator membranes which are capable of producing solutions having a relatively high concentration of alkali metal hydroxides as compared with asbestos fiber diaphragm type cells now in predominant usage. Production of these concentrated solutions in commercial "diaphragm-type" electrolytic cells currently available requires, however, high cell voltages and results in increased power costs in operating the cells. By "diaphragm-type" is meant an electrolytic cell having the electrolyte separated into anolyte and catholyte by a permeable or semi-permeable separator material so as to at least lessen the amount of halogen in the alkali metal hydroxide output stream. By "membrane-type" is meant an electrolytic cell having the electrolyte separated into anolyte and catholyte by an ion exchange separator material, preferably of a cation permeable composition such as a perfluorocarbon polymer having pendant sulfonic groups such as marketed by DuPont Corporation under the trademark Nafion®.

Is is now customary to place the membrane on the cathode so that there is little or no space between the membrane and the cathode, even though this arrangement impedes the release of hydrogen bubbles formed at the cathode.

This historic trend toward use of cathode-surrounding membranes is largely a result of the vacuum deposition methods traditionally utilized to place asbestos fiber diaphragms on cathodes and the normal flow of electrolyte being from anolyte to catholyte. Placement on the anode would require the diaphragm to withstand tensile or ballooning forces caused by conventional flow. With the advent of fabric-like membranes and more cohesive diaphragms, we have found it possible to now enclose the anode rather than the cathode.

U.S. Pat. No. 3,984,303, issued to E. J. Peters and J. E. Loeffler, Jr., describes a cell having a series of individual units in which a hollow cylindrical cathode is concentrically arranged around a hollow cylindrical anode. The anode has a tubular ion permeable membrane covering its outer surface. While removing the membrane from the cathode, the concentric electrodes are limited in size, expensive to fabricate and cell operation would result in high energy costs. Furthermore, such a design wastes space as compared with planar interleaved anodes and cathodes since only one side of the anodes and cathodes is utilized as opposed to both sides in an interleaved planar electrode arrangement. There is a need for a cell design which allows use of beneficial aspects of both designs. Yet, the planar design seems to require membranes having a complex glove-like structure, although being largely adaptable to cell structures previously utilizing the vacuum deposited diaphragms.

Therefore it is an object of the present invention to provide a membrane cell having improved hydrogen release capabilities.

Another object of the present invention is to provide a membrane cell having reduced energy costs while producing concentrated alkali metal hydroxide solutions.

A further object of the present invention is to provide a membrane cell which permits an enlarged space between the cathode and the membrane while reducing the cell voltage.

An additional object of the present invention is a membrane cell in which the anode is spaced apart from the membrane by spacing means which prevent contact between the electrochemically active portions of the anodes and the membrane.

Another object of the present invention is a membrane cell which employs conventional diaphragm-type cell plants.

Yet another object of the present invention is to make the separator more easily repairable and repairable without requiring removal of the entire separator from the cell.

A solution to these and other problems is the present invention which provides an electrode separator combination unit for use in an electrolytic cell having an electrolyte and multiple planar interleaved electrode, comprising:

(a) planar foraminous electrode means, for one of receiving an electrical current from said electrolyte and transmitting an electric current to said electrolyte;

(b) a plurality of separator means, sealed along adjacent edges and individually enclosing each of said electrode means and having at least one perforation therethrough, for separating said electrode means from a portion of said electrolyte while allowing at least cations to pass through said perforation; and (c) electrical conductor means, passing through said perforations and contacting said enclosed electrode means for one of receiving an electrical current from and transmitting an electrical current to said electrode means.

In another aspect, the invention provides an electrolytic cell comprising:

(a) cell housing means for defining a chamber containing an electrolyte;

(b) a plurality of first electrical conductors passing through said housing and having an exterior surface;

(c) a plurality of first planar parallel electrodes of a given polarity disposed within said chamber, said first electrodes being in planar electrical contact with said electrolyte and in electrical contact with at least one of said conductors;

(d) a plurality of second electrical conductors passing through said housing and spaced from said first plurality of electrical conductors;

(e) a plurality of second planar parallel electrodes of opposite polarity to said first electrode means, disposed within said cell body and alternatingly interleaved in spaced parallel relationship with said first electrodes and in planar electrical contact with said electrolyte and in electrical contact with at least one of said second conductors;

(f) a plurality of first separator means, individually encapsulating each of said first electrodes, for dividing said chamber into a plurality of individual chambers within and immediately surrounding each of said first electrodes and a single common chamber within and immediately surrounding all of said second electrodes, said separator means being at least ion permeable, each separator means having portions defining at least one first perforation for passage of at least one of said first conductors through said separator means to the first electrode means therewithin; at least one second perforation for passage of supply fluid into said individual chamber and at least one third perforation for passage of product fluid out of said individual chamber; and (g) seal means for preventing fluid communication through said perforations between said individual chambers and said common chamber while allowing passage of said first conductors, supply fluid and product fluid therethrough.

In yet another aspect, the invention provides a method of assembling a combination electrode-separator unit for use in electrolytic cells having interleaved parallel planar cathodes and anodes, which comprises the steps of:

(a) encapsulting an electrode with a layer of separator material to create a first electrolyte chamber within said layer, and (b) providing for passage of an electrical conductor, a supply fluid conduit and a product fluid conduit through said layer into said created first electrolyte chamber.

In a still further aspect, the invention provides a method of assembling a combination electrode-separator unit, having conductor posts and fluid inlet and outlet conduits, for an electrolytic cell, which comprises the steps of:

(a) cutting a separator sheet to a size sufficient to surround an electrode with allowance for sealing of edges of said sheet;

(b) perforating holes at predetermined locations in said separator sheet;

(c) inserting each of the conductor posts and fluid inlet and outlet conduits through predetermined ones of said perforations in said sheet;

(d) folding said sheet over said electrode to produce two spaced panels, said panels lying on opposite sides of said electrode; and (e) sealing said panels together along three edges of each of said panels to form a closed separator envelope with said electrode inside.

In yet another aspect, the invention provides a separator for use in an electrolytic cell having a plurality of parallel interleaved planar electrodes, fluid outlet and inlet pipes and electrical conductors leading to said electrodes and seal means associated with each of said conductors and pipes, comprising a pair of parallel planar sheets of separator material connected along adjacent first edges by a U-shaped portion of separative material and along three other remaining adjacent edges by heat sealed portions, said U-shaped portion having a perforation at each of at least three separate predetermined locations, each of said perforations being adapted to receive one of said pipes and conductors.

In a final aspect, the invention provides a method for replacement of a faulty portion of a separator means of a diaphragm type electrolytic cell having planar interleaved electrodes with all cathodes separated from all anodes by said separator means, said method comprising the steps of:

(a) removing an electrode individually enclosed by said faulty portion from said cell while leaving all other electrodes and all sound portions of said separator intact; and (b) replacing said electrode and surrounding portion, as a unit, by a corresponding sound portion and enclosed electrode, as a unit.

Accompanying FIGS. 1–14 illustrate the present invention. Corresponding parts have the same numbers in all figures.

FIG. 2 is a horizontal cross sectional partial view of an anode assembly taken along lines 2—2 of FIG. 1.

Figure 1:
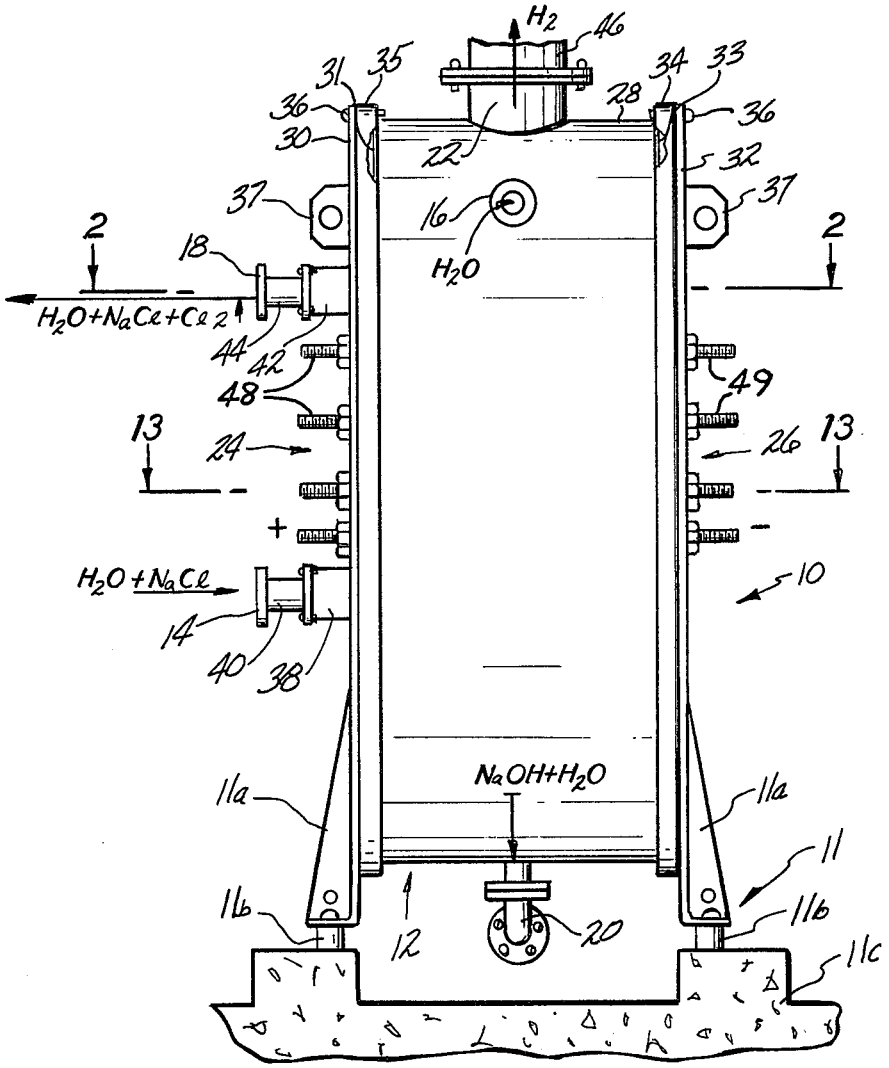
FIG. 1 is a side elevational view of a membrane cell embodying the present invention.

Referring now to FIG. 1, an electrolytic cell 10 is seen which comprises support means 11, a housing 12, an anolyte inlet 14, a catholyte inlet 16, an anolyte outlet 18, a catholyte liquid outlet 20, a catholyte gas outlet 22, an anode assembly 24 and a cathode assembly 26. Housing 12 includes a body portion 28, an anode backplate 30, an anode backplate gasket 31, a cathode backplate 32 and a cathode backplate gasket 33. Body 28 can be a tubular metallic member having flanges 34 and 35 attached to its respective ends, flanges 34 and 35 being adapted to receive cathode backplate 32 and anode backplate 30, respectively. Backplates 30 and 32 can be metallic discs attached to flanges 35 and 34, respectively, by the use of bolts 36 or any other removable attachment means. Gaskets 31 and 33 would be interposed between backplate 30 and body 28 and backplate 32 and body 28, respectively, in order to sealingly enclose and define an electrolyte chamber within housing 12. Housing 12 is provided with suitable openings, as described below, in order to allow raw materials to enter the electrolyte chamber defined therewithin and to allow the removal of products therefrom.

Anolyte inlet 14 comprises a brine supply header 38 and a brine supply connector 40 for purposes described below. Catholyte liquid outlet 20 is connected to the bottom of body 28 in order to allow removal of catholyte as described below. Anolyte outlet 18 comprises a chlorine gas and spent brine header 42 and a spent brine outlet connector 44 which will be described below in more detail. Catholyte inlet 16 is connected to an upper portion of body 28 in order to allow supply of catholyte liquid to the interior of cell 10. This arrangement provides downward flow of catholyte through cell 10 to catholyte liquid outlet 20. Also provided is a catholyte gas outlet 22 atop cell body 28 leading to a hydrogen withdrawal pipe 46. Outlet 22 allows removal of gases from adjacent the cathodes within cell 10 as described below. Conductor rods 48 and 49 from anode assemblies 24 and cathodes (not shown), respectively, are connected in conventional manner to an external DC power source (not shown) to provide an electric current through cell 10.

Anode backplate 30 and cathode backplate 32 are provided with lugs 37 to enable cell 10 to be lifted or otherwise moved and to facilitate removal of backplates 30 and 32 from cell body 28. Also attached to backplates 30 and 32 are support flanges 11*a* which rest on insulators 11*b* which in turn rest upon foundation 11*c* in order to support cell 10. Flanges 11*a*, insulators 11*b* and foundation means 11*c* together comprise support means 11.

Figure 3:
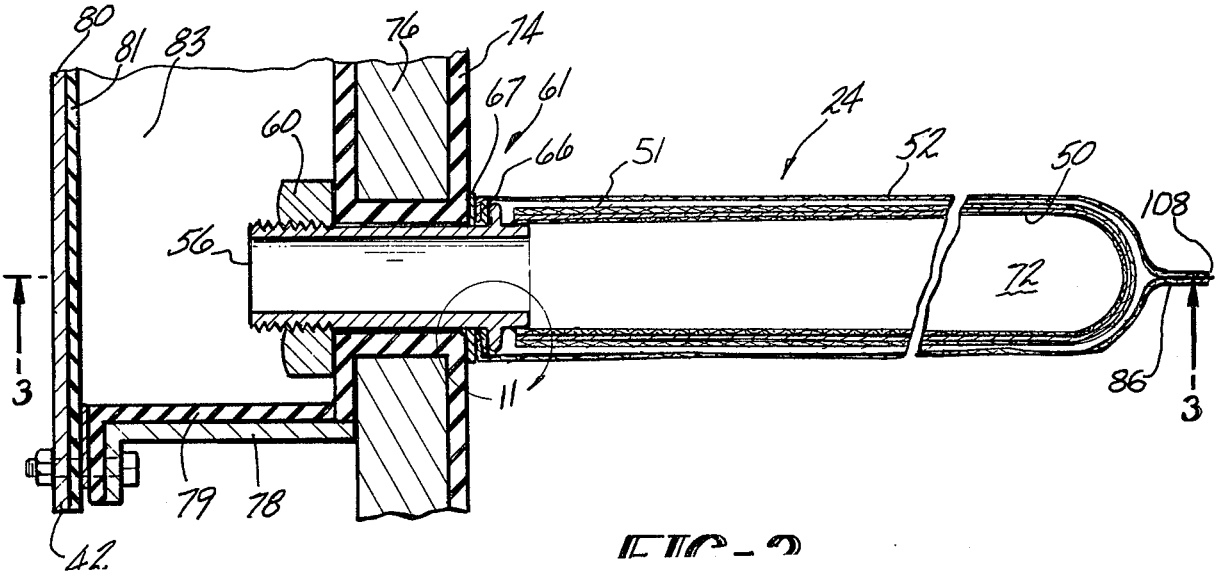
FIG. 3 is a vertical cross sectional view taken along lines 3—3 of FIG. 2, further showing an anode assembly of the present invention.

The construction and configuration of anode assembly 24 is best seen by reference to FIGS. 2 and 3 and comprises anode conductors 48, mesh 50, membrane 52, brine supply tube 54 and anolyte outlet tube 56. Optionally, a spacer 51 can be provided, separating mesh 50 from membrane 52. Mesh 50 is an electrically conductive material connected to the conductors 48 in conventional manner such as to allow current to flow therebetween. Mesh 50 can preferably be a U-shaped planar foraminous structure enclosing an anolyte chamber 72, or could be of any other suitable design such as, for example, a louvered electrode and could be with or without internal gas baffling. Mesh 50 is supported by conductors 48 which are in turn attached to anode backplate 30 by jamb nuts 58 threaded onto conductors 48. Tube 56 can project horizontally from the upper end of mesh 50 or be otherwise oriented in order to provide for flow of gases and liquids out of chamber 72 and into header 42. Tube 56 is welded or otherwise attached to mesh 50 and passes through suitable openings, described below, in membrane 52. Surrounding mesh 50 is a membrane 52, the construction of which will be described below, membrane 52 serving to contain anions such as chlorine ions within chamber 72 while allowing the passage of cations into the cathodic portion of cell 10. Header 42 comprises side wall 78, side wall lining 79, end wall 80, end wall lining 81, top wall 82, top wall lining 85, bottom wall lining 83 and bottom wall 84. Header 42 lies generally horizontal and serves to connect each of the anolyte outlet tubes 56 to the spent brine outlet connector 44 (not shown in FIG. 3). The linings 79, 81, 83 and 85 serve to protect walls 78, 80, 84 and 82, respectively from corrosion caused by chlorine or other products exiting from tube 56. The particular structure of header 42 can be varied, so long as it serves to connect each tube 56 with outlet connector 44. In similar fashion, a brine supply header 38 is provided to connect brine supply connector 40 with each brine supply tube 54 leading to chamber 72. Header 38 can be lined in similar fashion to header 42 in order to provide corrosion resistance. Brine supply tube 54 is attached to mesh 50 and projects outwardly therefrom and passes through anode backplate 30 and is attached by means of jamb nut 59 and suitable threads on the outer end of tube 54 to anode backplate 30.

Membrane 52 is sealed along edges 106, 108 and 110 by any suitable sealing means, such as heat sealing, to provide a U-shaped seal 86 and is sealed at the points where conductors 48, tube 54 and tube 56 pass through membrane 52 by sealing means 61, described below. Sealing means 61 and seal 86 serve to close membrane 52 about mesh 50 and chamber 72 lying within mesh 50. Membrane 52 includes two portions 88 and 90 lying loosely and non-adherently on opposite sides of mesh 50 and serving to separate mesh 50 from adjacent cathodes as described below.

Figure 7:
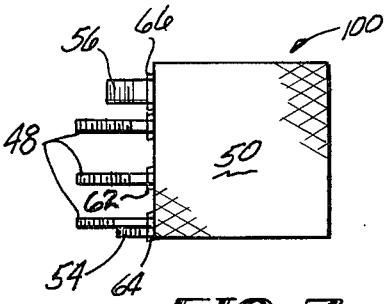
FIGS. 7–10 are side elevational views showing the assembly of an anode-separator unit utilizing the separator of FIG. 6.
Figure 8:
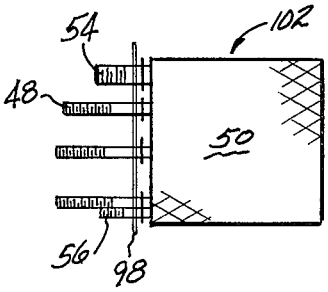
Figure 9:
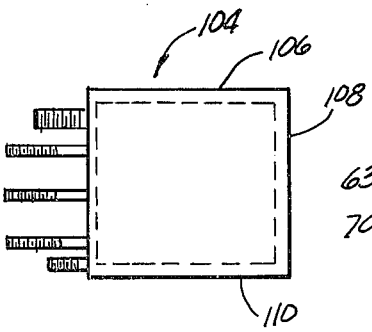
Figure 10:
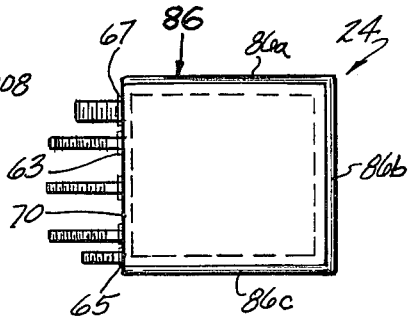
Figure 11:
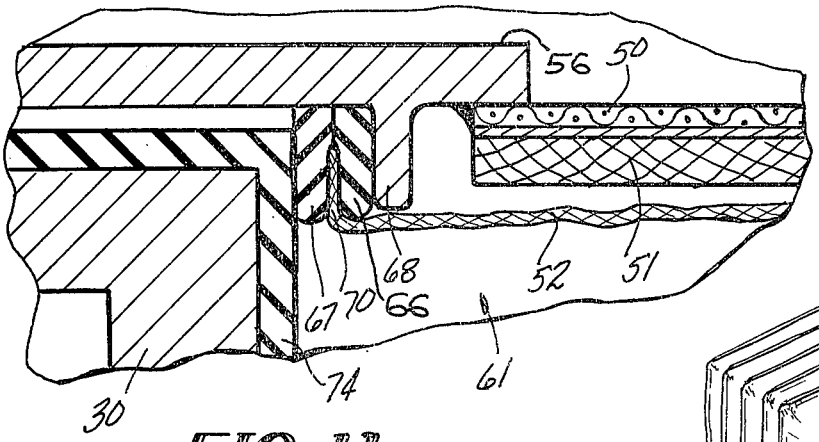
FIG. 11 is an enlarged cross sectional view of portion 11 of FIG. 2 showing one preferred sealing means of the present invention.

Referring now to FIG. 11, the sealing means 61 will be described in more detail. Sealing means 61 includes an inside gasket 66, an outside gasket 67 lying on the inside and outside of a central portion 70 of membrane 52, respectively, and surrounding tube 56 to seal between tube 56, central portion 70 and anode backplate 30. Gaskets 66 and 67 can be compressed and restrained by an annular flange 68 on tube 56 during the tightening of tube 56 against anode backplate 30 in response to the tightening of a jamb nut 60. As shown in FIGS. 7 and 10, inside gasket 62 and outside gasket 63 are provided for each conductor 48 to seal between conductors 48, membrane 52 and anode backplate 30. An annular flange can be provided on each conductor 48 in order to compress gaskets 62 and 63 in response to the tightening of jamb nuts 58. Likewise, an inside gasket 64 and outside gasket 65, as seen in FIG. 3, can be provided on the inside and outside of membrane 52 at the point where tube 54 passes through membrane 52. An annular flange can be provided on tube 54 in order to compress gaskets 64 and 65 in response to the tightening of the jamb nut 59. Thus as the anode separator unit 24 is attached to anode backplate 30 and jamb nuts 58, 59 and 60 are tightened, the perforations through which conductors 48, tube 54 and tube 66 pass through membrane 52 are sealed to envelop or "encapsulate" mesh 50. Backplate 30 can include a body portion 76 with an inner lining 74 for corrosion resistance, as in FIGS. 2 and 11, or alternatively be unlined where a cation exchange membrane is used as separator 52 and the conductors 48 are separated from backplate 30 by an insulating sleeve (not shown) or other insulating means.

Figure 12:
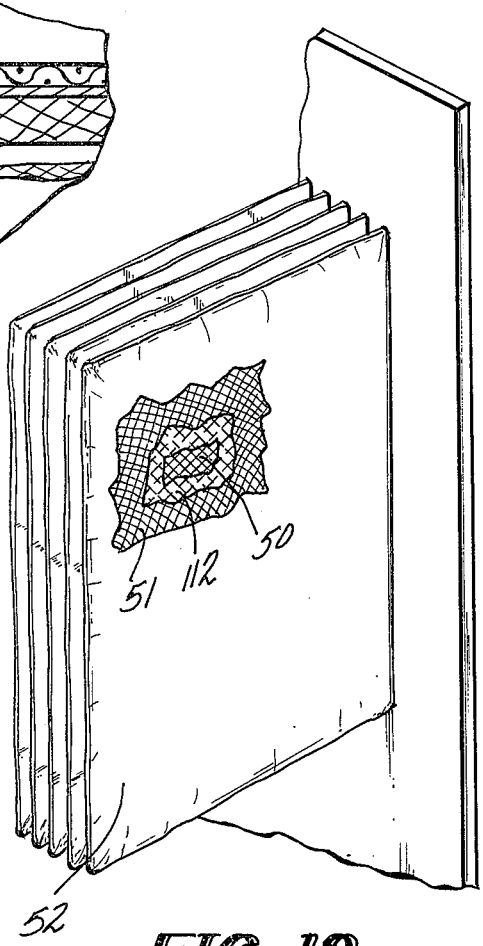
FIG. 12 is a side perspective view showing a plurality of anode-separator units attached to an anode backplate.

FIG. 12 is a side perspective view showing a plurality of anode-separator units or anode assemblies 24 supported from the side of anode backplate 30. A cutaway view is provided showing some of the interior portions of one of these assemblies 24. Specifically a spacer 51 is seen lying immediately within membrane 52. Lying within spacer 51 coated onto the exterior of mesh 50 is an optional catalytic coating 112 which can be of any electrocatalytically active material such as a "platinum group" metal, i.e. an element of the group consisting of ruthenium, rhodium, palladium, osmium, iridium and platinum. Mesh 50 is seen to be a planar foraminous metal anode structure which preferably has two parallel planar surfaces as best seen in FIGS. 2, 3, 13 and 14. The units or assemblies 24 are planar and are spaced in parallel so as to allow interleaving of a plurality of conforming planar parallel spaced cathodes between said anode separator units, as seen below in FIG. 13.

Figure 13:
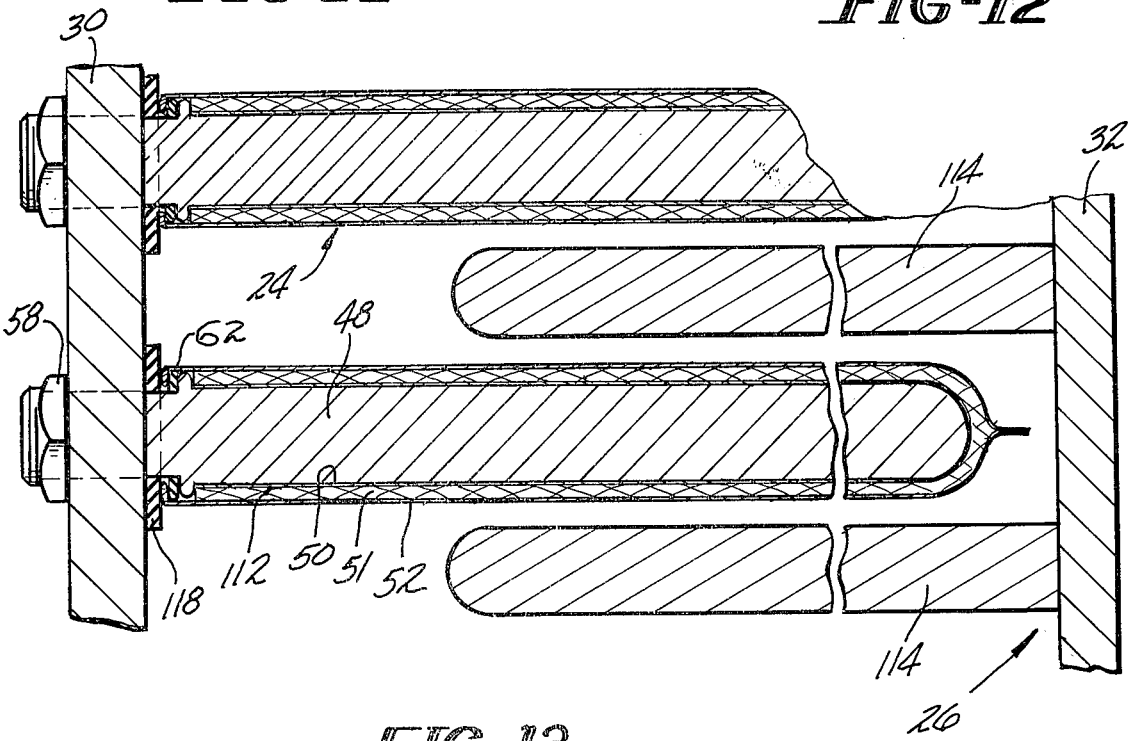
FIG. 13 is a horizontal cross sectional view taken along lines 13—13 of FIG. 1 showing a preferred relationship of cathodes and anodes within the electrolytic cell of FIG. 1.

FIG. 13 is a horizontal cross sectional view along lines 13—13 of FIG. 1 showing parallel interleaving of planar cathodes 114 and assemblies or units 24. Backplates 30 and 32 are seen lying in spaced parallel relationship with units 24 and cathode 114 supported respectively therefrom. Units 24 are attached by means of jamb nuts 58 threadly attached to threaded ends of conductors 48. As previously seen in FIGS. 2 and 3, units 24 are preferably also held by jamb nuts 59 and 60. While jamb nuts 58, 59 and 60 are shown, it is within the scope of the invention to provide any other conventional tightening means which can provide compression of sealing means 61. The advantage of jamb nuts 58, 59 and 60 is that rapid disassembly is made possible. It will also be understood that jamb nuts 59 and 60 are optional and can be deleted by use of a conventional dynamic seal means (not shown) at the point tubes 54 and 56 pass through membrane 52 so as to allow easier removal of units 24 by avoiding the otherwise needed removal of headers 38 and 42 in order to get to nuts 59 and 60. Also seen in FIG. 13 is the use of an unlined anode backplate which can result from the sealing of the perforations of membrane 52 by use of sealing means 61 and insulation of conductors 48 from backplate 30. Sealing means 61 can be modified for this purpose by replacing gasket 67 with a larger gasket 118. Conventional diaphragm-type cells may be modified to likewise utilize the concept of individually enclosed anode units 24, and could apply the concept to cathodes rather than anodes. That is, the cathode could be enclosed by a synthetic separator (not shown) in similar fashion to the enclosure of the anode of FIGS. 1–14. In fact, the enclosed electrode concept could be utilized on both anodes and cathodes to produce a three compartment cell, were such desired. Suitable cathode headers (not shown) would be required to connect the individual cathode-separator units in either case.

The units 24 of FIG. 13 also include a porous spacer 51, although this is an optional feature. Membrane 52 is thus spaced from both anode and cathode in order to allow gas to flow upwardly through cell 10 without undue restriction by membrane 52. This gas flow can be assisted by addition of a "gas collecting device" within the anode unit 24 such as baffles, collectors or sloped or arcuate conductor shapes (not shown) in order to help collect and carry gaseous products of electrolysis toward conduit 56. A gap could be provided at the end of unit 24 closest to backplate 30 by use of suitable spacer collars and extra gaskets (not shown) about conductors 48, pipe 54 and pipe 56.

Figure 14:
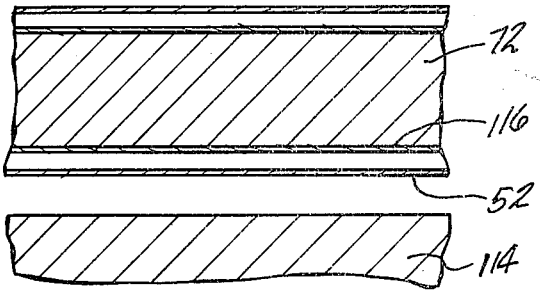
FIG. 14 is a partial horizontal sectional view of another embodiment of an anode-separator unit of the present invention taken along lines 13—13 of FIG. 1.

While solid cathodes 114 are depicted in FIGS. 13 and 14, foraminous mesh cathodes (not shown) of design similar to anodes mesh 50 could be utilized having catalytic coating or overvoltage reducing platings thereon as desired. Furthermore, either anodes or cathodes, or both, could be made contractable by use of a biasing mechanism to urge the two planar surfaces of mesh 50 or similar cathodic mesh surfaces apart, the advantage to such expandability being that the electrodes could contract during assembly and thereafter expand. Such a mechanism is shown in copending application Ser. No. 782,643 filed Mar. 30, 1977 by Steven J. Specht, the disclosure of which is herein incorporated by reference as if set forth at length and which describes a vacuum-assisted method of assembly utilizing a flexible electrode enclosed by a separator capable of maintaining a pressure gradient so as to exert compressive forces on the flexible electrode to contract it during assembly.

Mesh 50 is shown in FIG. 13 with an outside catalytic coating 112 while FIG. 14 shows mesh 50 with an inside catalytic coating 116. Where the outside coating 112 is provided, gas products will tend to be produced at the outside coating 112 and hence it is desirable to have a porous spacer 51 to provide a space for the gas to flow upwardly for removal from the cell and to minimize overvoltages. Such a spacer can be, for example, a screen or net suitably composed of any non-conducting material.

By use of a spacer 51, the electrocatalytically coated portions of the foaminous metal anode structure can be prevented from adhering to the membrane by a spacing means. Direct contact between the membrane and electrocatalytically coated portions results in the loss of current efficiency and when using a platinum group coating, can result in an increased rate in the loss or removal of the platinum group component from the electrode surface.

In the embodiment of FIG. 13, the spacing means is, for example, a screen or net suitably composed of any non-conducting porous chlorine-resistant material. Typical examples include glass fiber, asbestos filaments, plastic materials, for example, polyfluoroolefins, polyvinyl chloride, polypropylene and polyvinylidene chloride, as well as materials such as glass fiber coated with a polyfluoroolefin, such as polytetrafluoroethylene.

Any suitable thickness for the spacing means may be used to provide the desired degree of separation of the anode surface from the diaphragm. For example, spacing means having a thickness of from about 0.003 to about 0.125 of an inch may be suitably used with a a thickness of from about 0.010 to about 0.080 of an inch being preferred. Any mesh size which provides a suitable opening for brine flow between the anode and the membrane may be used. Typical mesh sizes for the spacing means which may be employed include from about 0.5 to about 20 and preferably from about 4 to about 12 strands per lineal inch. The spacing means may be produced from woven or non-woven fabric and can suitably be produced, for example, from slit sheeting or by extrusion.

While it is not required, if desired, the spacing means may be attached to the anode surfaces, for example, by means of clamps, cords, wires, adhesives, and the like.

In another embodiment, the spacing means is the foraminous metal anode structure itself. As illustrated in FIG. 14, the surface of the foraminous metal structure which is coated with the electrocatalytic material is positioned so that it faces away from the membrane 52. That is, an inside coating 116 is provided rather than coating 112. The membrane contacts the uncoated surface of the foraminous metal structure. The coated portion of the foraminous metal anode is spaced apart from the membrane by a distance which is equal to the thickness of the foraminous metal structure. This distance, as cited above, is from about 0.03 to about 0.10, and preferably from about 0.05 to about 0.08 of an inch.

Enclosing the foraminous metal anode structures and the spacing means is a membrane 52 composed of an inert, flexible material having cation exchange properties and which is impervious to the hydrodynamic flow of the electrolyte and the passage of chlorine gas and chloride ions. A first preferred membrane material is a perfluorosulfonic acid resin membrane composed of a copolymer of a polyfluoroolefin with a sulfonated perfluorovinyl ether. The equivalent weight of the perfluorosulfonic acid resin is from about 900 to about 1600, and preferably from about 1100 to about 1500. The perfluorosulfonic acid resin may be supported by a polyfluoroolefin fabric. A composite membrane sold commercially by E. I. DuPont deNemours and Company under the trademark "Nafion" is a suitable example of the preferred membrane.

A second preferred membrane is a cation exchange membrane using a carboxyl group as the ion exchange group and having an ion exchange capacity of 0.5–2.0 mEq/g of dry resin. Such a membrane can be produced by chemically suitable a carboxyl group for the sulfonic group in the above-described "Nafion" membrane to produce a perfluorocarboxylic acid resin supported by a polyfluoroolefin fabric. A second method of producing the above-described cation exchange membrane having a carboxyl group as its ion exchange group is that described in Japanese Patent Publication No. 1976–126398 by Asahi Glass Kabushiki Gaisha issued Nov. 4, 1976. This method includes direct copolymerization of fluorinated olefin monomers and monomers containing a carboxyl group or other polymerizable groups which can be converted to carboxyl groups.

In the membrane enclosed anode of the cell of the present invention, the membrane is obtained in tube or sheet form and sealed, for example, by heat sealing, along the appropriate edges 106, 108 and 110 to form a closed casing or "envelope." This envelope defines a plurality of anolyte chambers 72 therewithin. As illustrated in FIGS. 2 and 3, the anodes and cathodes are of the finger-type which are well known in commercial diaphragm-type electrolytic cells. A preferred type cell is that in which the finger-like electrodes are attached to vertically positioned electrode plates, as illustrated by U.S. Pat. No. 3,898,149, issued Aug. 5, 1975, to M. S. Kircher and E. N. Macken, modified to have headers 38 and 42.

In the membrane enclosed anode of one cell of the present invention, the gap between the foraminous metal anode surface and the membrane is from about 0.003 to about 0.125 of an inch, preferably.

Spaced apart from the membrane enclosed anodes are cathodes which are positioned, as illustrated in FIG. 13, such that the cathode is interleaved between adjacent anodes. The cathodes are foraminous metal structures of metals such as steel, nickel or copper. The structures are preferably fabricated to facilitate the release of hydrogen gas from the catholyte liquor. It is preferable that the cathodes have an open area of at least about 10 percent, preferably an open area of from about 30 to about 70 percent, and more preferably an open area of from about 45 to about 65 percent.

As illustrated in FIG. 13, the space between cathodes 114 and the membrane 52 is preferably greater than the space between the anode surfaces and the membrane. In addition, this cathode-membrane gap is free of obstructing materials such as spacers, etc. to provide maximum release of hydrogen gas. The cathodes are spaced apart from the membranes a distance of from about 0.040 to about 0.750, and preferably from about 0.060 to about 0.500 of an inch. It is surprising that, in producing alkali metal hydroxide solutions containing at least about 30 percent by weight of the alkali metal hydroxide, an increase in the cathode-membrane gap results in a decrease in cell voltage. The cathodes are attached to a cathode plate which is positioned so that the cathodes are interleaved with the membrane enclosed anode compartments, as shown in FIG. 13. The cathode compartment is the entire area of the cell body which is not occupied by the membranes enclosed anodes, and provides a voluminous section for hydrogen gas release from the alkali metal hydroxide.

The cathode structures employed in the membrane cell of the present invention may have electrocatalytically active coatings similar to those used on the anodes. They may also be coated with metals such as nickel or molybdenum or alloys thereof.

Figure 4:
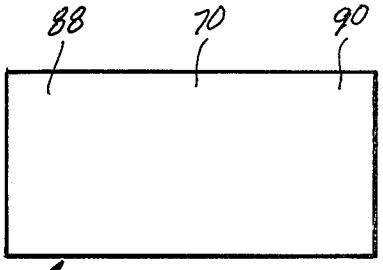
FIGS. 4–6 are top plan views of various stages in the assembly of a separator of the present invention.
Figure 5:
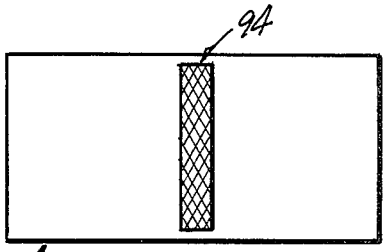
Figure 3:
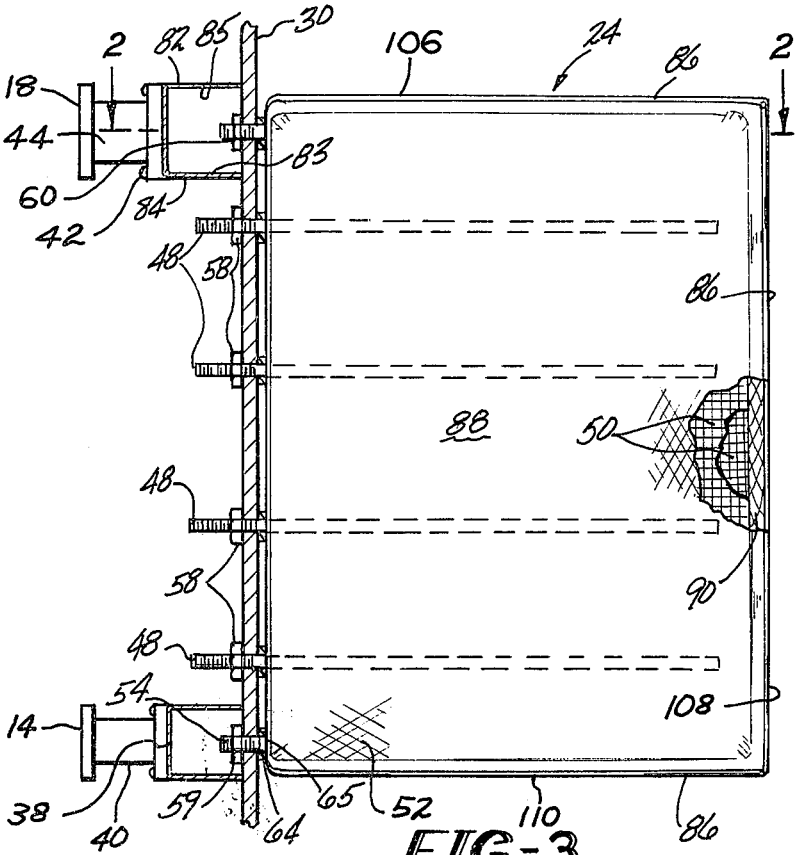
Figure 6:
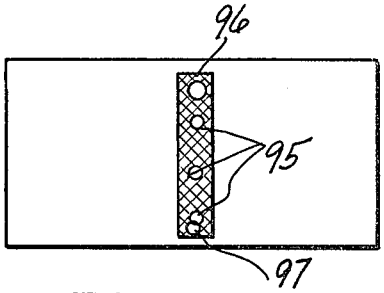

FIGS. 4–10 show the fabrication procedure for assembling the anode-separator assembly or unit 24 of FIGS. 1–3 and 11–14. As seen in FIG. 4, a rectangular sheet 92 of separator material, for example, a cation exchange membrane of perfluorosulfonic acid resin or other heat sealable impereable membrane or permeable diaphragm, is the starting point. The sheet 92 can be considered to have a central portion 70 and two side portions 88 and 90. The central portion 70 can be reinforced by adding an additional layer 94 of separator or other material to central portion 70 to produce reinforced sheet 93 for strengthening against damage during assembly or cell operation and because perforations 95, 96 and 97 (FIG. 6) are next made in central portion 70 at predetermined locations and of predetermined size so as to later receive conductor 48 and pipes 54, 56 therethrough. Once the perforations 95, 96 and 97 are made, the perforated separator sheet 98 is ready for receipt of anode body 100. Anode body 100 includes mesh 50, conductors 48, pipes 54 and 56 and gaskets 62, 64, 66 which are placed around conductors 48 and pipes 54 and 56, respectively. Preferably conductors 48 and pipes 54 and 56 have annular flanges (such as flange 68 seen in FIG. 11 for pipe 56) to limit the inward movement of gaskets 62, 64 and 66 on conductors 48 and pipes 54 and 56 and to compress gaskets 62, 64 and 66 as previously described. After gaskets 62, 64 and 66 are in place, conductors 48 and pipes 54 and 56 are inserted through perforations 95 and 96 and 97, respectively, or perforated separator sheet to produce an unfolded assembly 102. Side portions 88 and 90 are then folded loosely against opposite sides of mesh 50 to form an unsealed folded assembly 104, having adjacent edges 106, 108 and 110. Edges 106, 108 and 110 are then sealed by any suitable means such as heat sealing to "encapsulate" mesh 50 and chamber 72 to create a loose fitting anode-separator unit 24 having a U-shaped sealed edge 86, bordering three sides and the perforated central portion 70 bordering the fourth side, as seen in FIG. 10.

The unit 24 can then become part of cell 10 by adding additional gaskets 63, 65 and 67 outside of central portion 70 about conductor 48 and pipes 54 and 56, respectively. If a full lining is used on backplate 30 (FIG. 2) gaskets 63, 66 and 67 could be deleted as gaskets 62, 64 and 66 would be able to seal against lining 74 to seal the perforations 95, 96 and 97.

Also repair of the membranes 52 is simplified as compared with conventional glove-like separator units. The cell is electrically disconnected and is drained through outlet 20 and connector 14, a lifting hook is attached to lugs 37 and bolts 36 of backplate 30 removed, backplate 30 is then removed and jamb nuts 58, 59 and 60 of a single unit 24 are removed, and conductors 48 and pipes 54, 56 pulled out of backplate 30. A new unit is then inserted and the jamb nuts 58, 59 and 60 tightened onto conductors 48 and pipes 54, 56 after their passage through backplate 30. The cell is then reassembled by reattaching backplate 30 with bolts 56 and refilling the cell and electrically reconnecting the cell.

EXAMPLE 1

A cell of the type illustrated in FIG. 1 is equipped with a plurality of titanium mesh anodes having portions covered by a coating having ruthenium dioxide as the electroactive component. A fiber glass open fabric coated with polytetrafluoroethylene and having a thickness of .035 of an inch is placed over the mesh anode. The anode mesh and surrounding fabric is enclosed in a perfluorosulfonic acid resin membrane having an equivalent weight of 1200. The membrane is perforated and heat sealed to form a plurality of individual casings which are placed over the individual anode structures and sealed against the anode plate linining to provide a plurality of self-contained compartments. Intermeshed with the anodes are steel screen cathodes having an open area of about 45 percent. The cathodes are spaced apart from the membrane about 0.50 of an inch to provide an unobstructed hydrogen release area. Sodium chloride brine having a concentration of about 300 grams per liter of NaCl and at a temperature of 86° C. is fed to each of the anode compartments. Sufficient electrical energy is supplied to the cell to provide a current density of 2 $KA/m^2$ to produce sodium hydroxide liquor in the cathode compartment containing about 400 grams per liter of NaOH at a cell voltage of 3.5 volts. Hydrogen release from the NaOH liquor is excellent as is the release of chlorine gas from the NaCl brine in the membrane enclosed anodes.

EXAMPLE 2

A cell of the type described in Example 1 is operated as described in Example 1 except that a perfluororcarboxylic acid resin membrane having an equivalent weight of 1200 enclosed the mesh anode and surrounding fabric instead of the perfluorosulfonic acid resin membrane of Example 1. Hydrogen release from the NaOH liquor is excellent as is the release of chlorine gas from the NaCl brine in the membrane enclosed anodes.

EXAMPLE 3

A cell of the type described in Example 1 is operated at the parameters of Example 1 except that a potassium chloride brine having a concentration of 400 grams KCl per liter of brine is fed to each of the anode compartments instead of the sodium chloride brine solution of Example 1 and a potassium hydroxide liquor is produced in the cathode compartment containing about 500 grams of KOH per liter of liquor instead of the NaOH liquor of Example 1. Hydrogen gas release from the KOH liquor and chlorine gas release from the KCl brine are both excellent.

What is claimed is:

1. A method of assembling a combination electrode separator unit for use in an electrolytic cell having a housing and interleaved parallel planar cathodes and anodes, which comprises the steps of:

(a) enveloping an electrode with a layer of separator material to create a first electrolyte chamber within said layer containing said electrode, and (b) providing for passage of an electrical conductor, a supply fluid conduit and a product fluid conduit through said housing and layer into said created first electrolyte chamber.

2. The method of claim 1, wherein said step of enveloping comprises the steps of:

(a) perforating a sheet of separator material;

(b) passing an electrical conductor in contact with said electrode through a perforation in said sheet;

(c) passing at least one conduit through at least one perforation in said sheet;

(d) folding said perforated sheet about said electrode;

(e) sealing together adjacent edges of said folded perforated sheet to form an envelope about said electrode; and (f) sealing between said perforations and said conduit and conductor so as to close said envelope about said electrode and prevent fluid flow through said perforations between said perforations and said conduits and conductors.

3. The method of claim 1 wherein said electrode is a cathode and said conduits are a catholyte supply line and a catholyte outlet line.

4. The method of claim 1 wherein said electrode is an anode and said conduits are an anolyte supply line and an anolyte outlet line.

5. The method of claim 1 further comprising placing a layer of inert spacer between said electrode and said sheet prior to said sealing.

6. The method of claim 1 wherein said separator material comprises a cation permeable perfluorocarbon polymer having pendant sulfonic groups.

7. The method of claim 1 wherein said separator material comprises a cation permeable perfluorocarbon polymer having pendant carboxylic groups.

8. The method of claim 1 wherein said method further comprises reinforcing a center portion of said sheet prior to said perforating and said perforating includes perforating said reinforced center portion so as to help strengthen the areas of said sheet surrounding said perforations.

9. The method of claim 1, further comprising depositing a catalytic coating on a surface of said electrode.

10. The method of claim 1, further comprising the step of providing, prior to said folding, a gas collecting device within said electrode.

11. The method of claim 1, further comprising expansively biasing said electrode within said encapsulated layer, while providing for limited contraction of said electrode within said encapsulated layer, so as to allow said electrode to contract during cell assembly and to thereafter expand.

12. A method of assembly a combination electrode separator unit, having conductor posts and fluid inlet and outlet conduits, for an electrolytic cell having a housing through which said posts and conduits can sealingly pass, which comprises the steps of:

(a) cutting a separator sheet to a size sufficient to surround an electrode with allowance for sealing of edges of said sheet;

(b) perforating said separator sheet at predetermined locations;

(c) inserting each of the conductor posts and fluid inlet and outlet conduits through at least one of said perforations in said sheet;

(d) folding said sheet over said electrode to produce two panels connected along an edge adjacent said conductor posts and conduits and separated along three remaining edges, said panels lying on opposite sides of said electrode; and (e) sealing said panels together along said three remaining edges of each of said panels to form a closed separator envelope with said electrode inside.

13. The method of claim 12 wherein said sheet is comprised of cation permeable membrane material.

14. The method of claim 13 wherein said membrane material comprises a perfluorocarbon polymer having pendant sulfonic groups.

15. The method of claim 14 wherein said polymer is a perfluorosulfonic acid resin.

16. The method of claim 14 wherein said polymer is a perfluorocarboxylic acid resin.

17. The method of claim 13 wherein said membrane material comprises a perfluorocarbon polymer having pendant carboxylic groups.

18. The method of claim 12, wherein said sealing is accomplished by heating said three edges of each of said two panels while pressing said edges together.

19. The method of claim 12, further comprising reinforcing said cut separator sheet with additional layers of said sheet at said predetermined locations.

20. The method of claim 12, wherein said method further comprises reinforcing said cut separator sheet with layers of an inert material at said predetermined locations so as to strengthen the portions of said sheet immediately surrounding said perforations.

21. The method of claim 12 wherein said sheet is comprised of a porous diaphragm material.

22. The method of claim 12 wherein said electrode includes a catalytic coated active surface.

23. The method of claim 12 wherein said electrode separator unit is provided with means for collecting and directing gas flow within said separator envelope toward said outlet conduit.

24. The method of claim 12, wherein said electrode is provided with means for allowing the electrode to change width during later cell assembly.

25. The method of claim 12, wherein said electrode is hollow and has two louvered mesh surfaces formed around an electrolyte chamber within said electrode.

26. The method of claim 12, further comprising placing an inert spacer between the electrode and the separator.

27. An electrode separator combination unit for use in an electrolytic cell having a housing, an electrolyte and multiple planar interleaved electrodes, comprising:

(a) planar foraminous electrode means, for providing electrical contact with said electrolyte;

(b) separator means, sealed along adjacent edges and individually loosely enclosing said electrode means and having at least one perforation therethrough, for defining an electrode containing chamber and separating said electrode containing chamber from a portion of said electrolyte while allowing at least cations to pass through said separator means;

(c) electrical conductor means, sealingly passing through said perforation and contacting said enclosed electrode means for conducting current between an external power source and said electrode means;

(d) connector means for supportively attaching said unit to the interior of said housing;

(e) inlet conduit means, sealingly passing through one of said perforations of said separator means, for introducing said electrolyte to said defined chamber from the exterior of said housing; and (f) outlet conduit means, sealingly passing through one of said perforations of said separator means, for withdrawing fluids to the exterior of said housing from said defined chamber.

28. The unit of claim 27 wherein said separator means comprises a sheet of separator material folded so as to generate a pair of spaced parallel planar separator panels connected at an edge by a U-shaped central portion of said sheet.

29. The unit of claim 28 wherein three remaining adjacent edges of said panels are sealed together to produce an enclosed chamber within said separator means, said enclosed chamber containing said electrode means and defined chamber.

30. The unit of claim 29 wherein:

(a) said separator means has at least three perforations through said central portion;

(b) said conductor means passing through at least one of said perforations; and (c) said inlet conduit means and outlet conduit means each sealingly pass through a separate one of said at least three perforations into said defined electrolyte chamber.

31. The unit of claim 28 wherein said perforations lie within said central portion of said sheet of separator material.

32. The unit of claim 27, wherein said separator means has at least three perforations.

33. The unit of claim 32, wherein said at least three perforations include a separate perforation of each of said conductor means, inlet conduit means and outlet conduit means.

34. The unit of claim 32, further comprising seal means, between said separator means and each of said conductor means, inlet conduit means and outlet conduit means for preventing fluid passage through said perforations external of any of said conductor means, inlet conduit means and outlet conduit means.

35. The unit of claim 27, wherein said withdrawn fluid is halogen gas and said introduced electrolyte is an alkali metal halide solution.

36. The unit of claim 35, wherein said halogen gas is chlorine, and said alkali metal halide solution is a concentrated sodium chloride brine solution.

37. The unit of claim 35, wherein said halogen gas is chlorine, and said alkali metal halide solution is a concentrated potassium chloride brine solution.

38. The unit of claim 27 wherein said withdrawn fluid is an alkali metal hydroxide and said introduced electrolyte is water.

39. The unit of claim 38 wherein said alkali metal hydroxide is a caustic soda solution.

40. The unit of claim 38 wherein said alkali metal hydroxide is a caustic potash solution.

41. The unit of claim 27 wherein said electrode is a cathode.

42. The unit of claim 27 wherein said electrode is an anode.

43. The unit of claim 27, wherein said separator means is comprised of a perfluorocarbon polymer having pendant sulfonic groups.

44. The unit of claim 27, wherein said separator means is comprised of a perfluorocarbon polymer having pendant carboxylic groups.

45. The unit of claim 27, wherein said separator is comprised of a porous diaphragm material.

46. The unit of claim 27, wherein said separator is comprised of a cation exchange membrane material.

47. The unit of claim 27 wherein said separator is reinforced about each of said at least one perforations with additional layers of inert material.

48. An electrolytic cell, comprising:

(a) cell housing means for defining a chamber containing an electrolyte;

(b) a plurality of first electrical conductors passing through and supportively attached to said housing means and having an exterior surface;

(c) a plurality of first planar parallel electrodes of a given polarity disposed within said housing means chamber, said first electrodes being in planar electrical contact with said electrolyte and in electrical contact with at least one of said conductors;

(d) a plurality of second electrical conductors passing through and supportively attached to said housing means and spaced from said first plurality of electrical conductors;

(e) a plurality of second planar parallel electrodes of opposite polarity of said first electrode means, disposed within said housing means chamber and alternatively interleaved in spaced parallel relationship with said first electrodes and in planar electrical contact with said electrolyte and in electrical contact with at least one of said second conductors;

(f) a plurality of first separator means, individually encapsulating each of said first electrodes, for dividing said chamber into a plurality of individual enclosed first chambers each containing one of said first electrodes and a single common second chamber within said cell housing containing all of said second electrodes, said separator means being at least ion permeable, each of said separator means having portions defining at least one first perforation of passage of at least one of said first conductors through said separator means to the first electrode means therewithin, at least one second perforation for passage of supply fluid into said individual chamber and at least one third perforation for passage of product fluid out of said individual chamber; and (g) seal means for preventing fluid communication through said perforations between said individual chambers and said common chamber while allowing passage of said first conductors, supply fluid and product fluid therethrough.

49. The cell of claim 48, further comprising:

(a) a plurality of inlet pipes, each one of said inlet pipes passing through one of said second perforations of an associated one of said plurality of first separator means;

(b) a supply header means for fluidly communicating each of said inlet pipes with a source of supply fluid;

(c) a plurality of outlet pipes, each one of said outlet pipes passing through one of said third perforations of an associated one of said plurality of first separator means, and (d) an outlet header means for fluidly communicating each of said outlet pipes with an outlet line.

50. The cell of claim 49 wherein said seal means includes a plurality of annular seals, adapted to fit sealingly about each of said conductors and pipes and sealingly overlap and abut the portions defining said perforations.

51. The cell of claim 50, wherein:

(a) said cell housing means includes a first backplate means for receiving said conductors, headers and pipes and for supporting said first electrodes; and (b) connector means for attaching each of said conductors and pipes to said backplate.

52. The cell of claim 51, wherein said seal means are pressed sealingly against said portion defining said perforations responsive to tightening of said connector means.

53. The cell of claim 52, wherein each of said conductors and pipes has annular flange means for pressing against and restraining said seal means responsive to tightening of said connector means.

54. The cell of claim 11, wherein:

(a) said first electrodes are cathodes; and (b) said individual chambers are catholyte-containing chambers.

55. The cell of claim 54, wherein said cell is a chlorine and alkali metal hydroxide production cell, said supply fluid is water and said product fluid is an alkali metal hydroxide solution and hydrogen gas.

56. The cell of claim 48 wherein each of said first electrodes includes two planar parallel foraminous conductive surfaces spaced to provide an electrolyte chamber therebetween for passage of fluids.

57. The cell of claim 56 wherein each of said second electrodes includes two planar parallel foraminous conductive surfaces spaced to provide an electrolyte chamber therebetween for passage of fluids.

58. The cell of claim 48, wherein:

(a) said first electrodes are anodes; and (b) said individual chambers are anolyte-containing chambers.

59. The cell of claim 48, wherein:

(a) said first electrodes are anodes, (b) said supply fluid is a brine solution, and (c) said product fluid is chlorine gas and depleted brine.

60. The cell of claim 48, further comprising a plurality of second separator means, individually encapsulating each of said second electrodes, for dividing said common chamber into a plurality of individual second chambers each containing one of said second electrodes and a single common zone between said first and second separator means.

61. The apparatus of claim 48 wherein said seal means includes:

(a) a product fluid outlet conduit adapted to pass through one of said third perforations;

(b) a supply fluid inlet conduit adapted to pass through one of said second perforations;

(c) a first perforation seal means for preventing fluid passage through said first perforation external to said one of said first conductors;

(d) a second perforation seal means for preventing fluid passage through said second perforation external to said supply fluid inlet conduit; and (e) a third perforation seal means for preventing fluid passage through said third perforation external to said product fluid outlet conduit.

62. The cell of claim 48, wherein:

(a) said first electrodes are anodes, (b) said individual chambers are anolyte-containing chambers, and (c) said cell housing has an unlined interior surface.

63. A separator, for use in an electrolytic cell of the type having a plurality of parallel interleaved planar electrodes, fluid outlet and inlet pipes and electrical conductors leading to said electrodes and seal means associated with each of said conductors and pipes, said separator comprising a pair of parallel planar sheets of separator material lying on opposite sides of an individual one of said electrodes, said sheets being connected along adjacent first edges by a U-shaped portion of separative material and along three other remaining adjacent edges by heat sealed portions, said U-shaped portion having a perforation of each of at least three separate predetermined locations, each of said perforations being adapted to receive one of said pipes and conductors.

64. A method for repair of a faulty loose fitting diaphragm of a diaphragm-type electrolytic cell having planar interleaved electrodes with all cathodes separated from all anodes by said loose fitting diaphragm, said method comprising the steps of:

(a) removing an electrode individually enclosed by a faulty portion of said diaphragm from said cell while leaving all other electrodes and all sound portions of said separator intact; and (b) replacing said electrode and surrounding faulty portion, as a unit, by a corresponding sound portion and enclosed electrode, as a unit.

65. A method for repair of a faulty loose fitting membrane of a membrane-type electrolytic cell having planar interleaved electrodes with all cathodes separated from all anodes by said loose fitting membrane, said method comprising the steps of:

(a) removing an electrode individually enclosed by a faulty portion of said membrane from said cell while leaving all other electrodes and all sound portions of said membrane intact; and (b) replacing said electrode and surrounding faulty portion, as a unit, by a corresponding sound portion and enclosed electrode, as a unit.

66. In an electrolytic cell of the type having a cell housing, at least two electrodes within said cell housing, a separator between said two electrodes, an electrode post attached to a first one of said two electrodes and passing from the exterior to the interior of said cell housing, through said separator, and electrolyte supply and product withdrawal passageways from the exterior of the interior of said cell housing, the improvement which comprises:

(a) a flanged conduit passing through said separator and one of said passageways, said flange disposed inside said cell housing;

(b) first gasket means, about said flanged conduit between said cell housing and said separator, for preventing fluid passage through said one of said passageways outside said flanged conduit;

(c) second gasket means, about said flanged conduit between said flange and said separator, for preventing fluid passage through said separator between said separator and said flanged conduit; and (d) tightening means, adjustably attached to said flanged conduit outside said cell housing, for compressing said gaskets between said housing and said flange to enhance the prevention function to said gaskets and to attach said flanged conduit rigidly to said cell housing.

67. The improvement of claim 66, further comprising:

(a) a flange attached to said electrode post and disposed inside said cell housing;

(b) first gasket means, about said electrode post between said cell housing and said separator for preventing fluid passage through said cell housing;

(c) second gasket means, about said electrode post between said flange and said separator for preventing fluid passage through said separator;

(d) tightening means, adjustably attached to said electrode post outside said cell housing, for compressing said first and second gaskets between said flange and said cell housing to enhance the prevention function of said gaskets and to attach said electrode post rigidly to said cell housing.

* * * * *

UNITED STATES PATENT AND TRADEMARK OFFICE

CERTIFICATE OF CORRECTION

PATENT NO. : 4,110,191
DATED : August 29, 1978
INVENTOR(S) : Steven J. Specht and John O. Adams It is certified that error appears in the above-identified patent and that said Letters Patent are hereby corrected as shown below:

Column 8, line 17, delete "a" (second occurrence).

Column 8, line 64, "suitable" should be --substituting--.

Column 9, line 28, "the" should be --a--.

Column 12, line 31, "assembly" should be --assembling--.

Column 14, line 11, "of" should be --for--.

Column 15, line 2, "of" should be --to--.

Column 15, line 4, "alternatively" should be --alternatingly--.

Column 15, line 18, "of" first occurrence should be -- for --

Column 16, line 58, "of" first occurrence should be -- at --

Column 18, line 12, "to" second occurrence should be -- of--

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*